US011937707B2

(12) United States Patent
Piretti

(10) Patent No.: US 11,937,707 B2
(45) Date of Patent: Mar. 26, 2024

(54) CHAIR WITH A FLEXIBLE BACKREST

(71) Applicant: Pro-Cord S.p.A., Bologna (IT)

(72) Inventor: Alessandro Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 13 days.

(21) Appl. No.: 17/830,397

(22) Filed: Jun. 2, 2022

(65) Prior Publication Data

US 2022/0386777 A1 Dec. 8, 2022

(30) Foreign Application Priority Data

Jun. 4, 2021 (IT) ..... 102021000014576

(51) Int. Cl.

| | |
|---|---|
| ***A47C 7/44*** | (2006.01) |
| ***A47C 3/021*** | (2006.01) |
| ***A47C 5/12*** | (2006.01) |
| ***A47C 7/28*** | (2006.01) |

(52) U.S. Cl.

CPC ..... *A47C 3/021* (2013.01); *A47C 7/44* (2013.01); *A47C 5/12* (2013.01); *A47C 7/282* (2013.01)

(58) Field of Classification Search

CPC ..... A47C 5/12; A47C 7/44; A47C 7/282
USPC ..... 297/285, 291, 452.56
See application file for complete search history.

(56) References Cited

U.S. PATENT DOCUMENTS 4,585,272 A * 4/1986 Ballarini ..... A47C 3/12 297/285
4,733,910 A * 3/1988 Brennan ..... A47C 7/448 297/285
4,913,493 A * 4/1990 Heidmann ..... A47C 7/448 297/285
4,981,326 A * 1/1991 Heidmann ..... A47C 7/441 297/285
5,102,196 A * 4/1992 Kaneda ..... A47C 3/12 297/285
5,904,397 A * 5/1999 Fismen ..... A47C 7/405 297/297
6,626,497 B2 * 9/2003 Nagamitsu ..... A47C 7/40 297/452.56
6,739,663 B2 * 5/2004 Gevaert ..... A47C 7/445 297/297
7,118,177 B2 * 10/2006 Piretti ..... A47C 7/44 297/285

(Continued)

FOREIGN PATENT DOCUMENTS

DE 102011018519 A1 * 9/2012 ..... A47C 7/40
EP 1557115 A1 7/2005

(Continued)

OTHER PUBLICATIONS

Italian Search Report dated Feb. 17, 2022. 7 pages.

*Primary Examiner* — Rodney B White
(74) *Attorney, Agent, or Firm* — RMCK Law Group PLC

(57) ABSTRACT

A chair having a backrest having an upper backrest section and a lumbar section, wherein the lumbar section is provided with a plurality of perforations and is elastically deformable to allow a backward tilting movement of the upper backrest section under a backward thrust applied from a user's back, and wherein the perforations stop the backward tilting movement of the upper backrest section in a position of maximum backward tilt of the upper backrest section.

6 Claims, 7 Drawing Sheets

(56) References Cited

U.S. PATENT DOCUMENTS

| | | | | |
|---|---|---|---|---|
| 7,396,079 | B2 * | 7/2008 | Heidmann | A47C 7/46 297/285 |
| 7,422,287 | B2 * | 9/2008 | Heidmann | A47C 7/444 297/285 |
| 8,172,332 | B2 * | 5/2012 | Masunaga | A47C 31/023 297/452.56 |
| 8,191,970 | B2 * | 6/2012 | Igarashi | A47C 7/44 297/452.15 X |
| 8,876,209 | B2 * | 11/2014 | Peterson | A47C 7/445 297/452.15 X |
| 8,979,199 | B2 * | 3/2015 | Ko | A47C 7/448 297/291 X |
| 8,991,932 | B2 * | 3/2015 | Okuda | A47C 7/44 297/452.31 |
| 8,998,321 | B2 * | 4/2015 | Piretti | A47C 7/44 297/301.4 |
| 9,192,237 | B2 * | 11/2015 | Bachar | A47C 7/445 |
| 9,332,851 | B2 * | 5/2016 | Machael | A47C 7/445 |
| 10,028,586 | B2 * | 7/2018 | Schneider | A47C 1/03238 |
| 10,172,465 | B2 * | 1/2019 | Machael | A47C 5/12 |
| 10,694,855 | B2 * | 6/2020 | Zhou | A47C 7/44 |
| 10,791,842 | B2 * | 10/2020 | Peterson | A47C 3/12 |
| 10,893,752 | B2 * | 1/2021 | Machael | A47C 7/46 |
| 2004/0140701 | A1 * | 7/2004 | Schmitz | A47C 7/44 297/284.4 |
| 2015/0296989 | A1 * | 10/2015 | Machael | A47C 7/44 297/284.7 |
| 2016/0135603 | A1 * | 5/2016 | Chan | A47C 7/36 297/285 |
| 2016/0235206 | A1 * | 8/2016 | Piretti | A47C 7/16 |
| 2017/0354254 | A1 * | 12/2017 | Diffrient | A47C 7/44 |
| 2018/0116403 | A1 * | 5/2018 | Tsai | A47C 3/04 |
| 2022/0378208 | A1 * | 12/2022 | Kamiya | A47C 1/03294 |
| 2023/0284780 | A1 * | 9/2023 | Yang | A47C 7/16 297/284.4 |
| 2023/0284784 | A1 * | 9/2023 | Piretti | A47C 7/443 297/301.1 |

FOREIGN PATENT DOCUMENTS

| | | | | |
|---|---|---|---|---|
| EP | 2347677 | A1 | 7/2011 | |
| EP | 2617325 | A1 * | 7/2013 | A47C 5/12 |
| EP | 3150088 | A1 | 4/2017 | |
| WO | 8704909 | A1 | 8/1987 | |
| WO | WO-2014063259 | A1 * | 5/2014 | A47C 5/12 |

* cited by examiner

CHAIR WITH A FLEXIBLE BACKREST

CROSS-REFERENCE TO RELATED APPLICATION

This application claims priority to Italian Patent Application No. 102021000014576 filed Jun. 4, 2021. The disclosure of the above application is incorporated herein by reference in its entirety.

FIELD OF THE INVENTION

The present invention relates to a chair with a flexible backrest

More precisely, the invention relates to a chair wherein the backrest has an upper section and a lumbar section extending between the upper section of the backrest and the seat, and wherein the lumbar section is elastically deformable to allow a backward tilt of the upper section of the backrest under the action of a backward push exerted by the user's back.

Possible embodiments relate to a chair including a seat and a backrest integrally formed in a single shaped piece of plastic material, which can be produced by injection molding.

DESCRIPTION OF THE PRIOR ART

EP-A-3058848 by the same Applicant describes a chair including a seat and a backrest formed from a single piece of injection-molded plastic material, wherein the structure comprises a transverse band in the shape of a bellows located in the lumbar section, and having a plurality of deformable portions with C-shaped cross-section, which allow a backward elastic deformation of the backrest.

EP-A-3150088 by the same Applicant describes a chair comprising a seat and a backrest formed in a single piece of injection-molded plastic material, wherein the backrest is connected to the seat by means of two flexible side uprights of plastic material, and wherein a through-opening is located in the lumbar area of the chair and extending between the two flexible side uprights.

In the design and manufacture of chairs with flexible backrests, there is the need to ensure an ergonomic behavior of the chair both in the resting condition and in the backward tilt of the backrest. There is also the need to ensure good elastic resistance to the backward thrust applied by the user's back.

A further requirement in the design and manufacture of chairs with flexible backrests is to ensure an effective stop to the backward tilt of the backrest.

OBJECT AND SUMMARY OF THE INVENTION

The object of the present invention is to provide a chair with a flexible backrest that allows said requirements to be satisfied According to the present invention, this object is achieved by a chair having the characteristics forming the subject of claim 1.

Preferred embodiments of the invention form the subject of the dependent claims.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
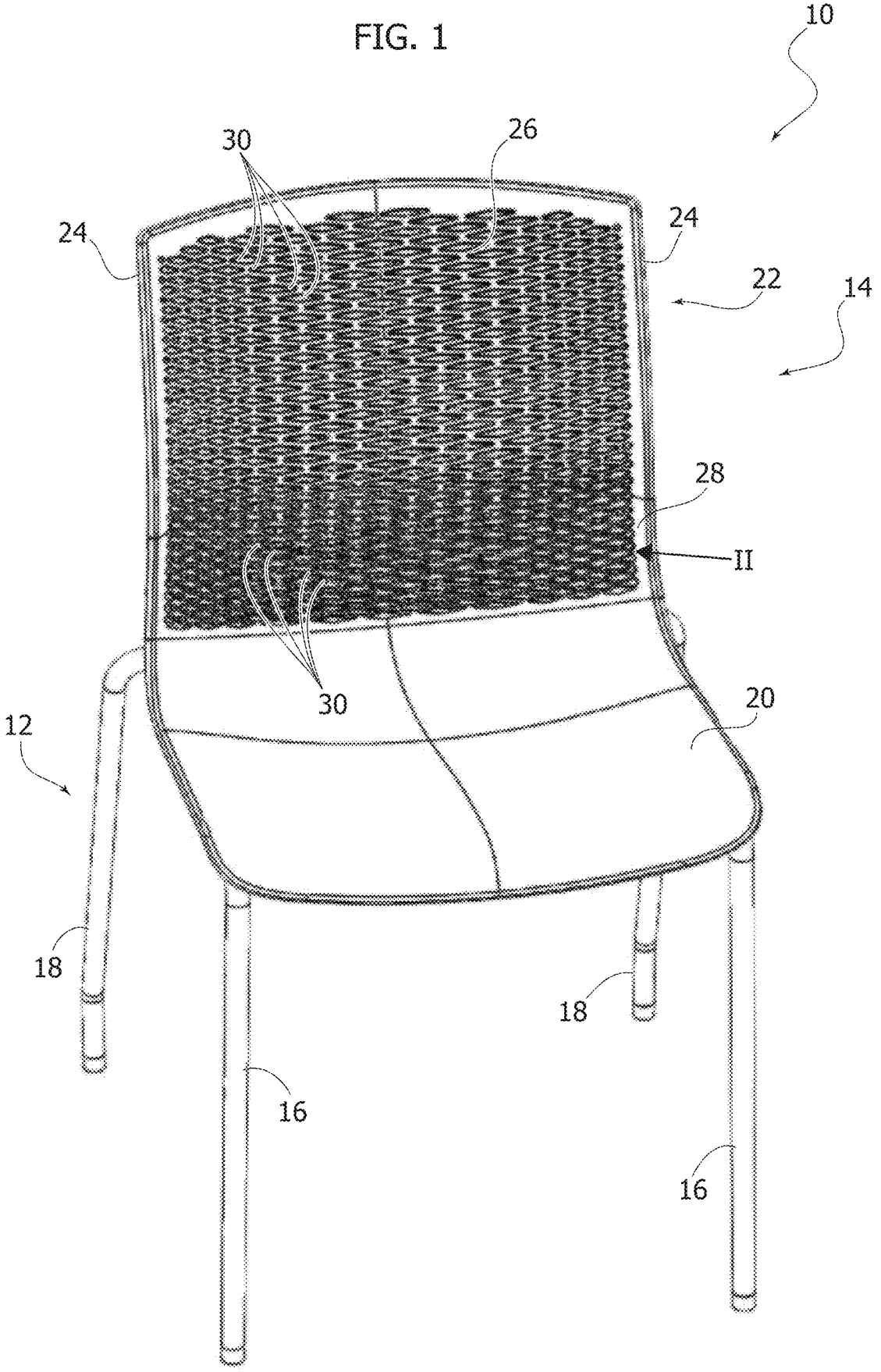
FIG. 1 is a perspective view of an embodiment of a chair according to the present invention.

With reference to FIG. 1, numeral 10 indicates a chair comprising a base 12 and a chair structure 14.

The base 12 may have two front legs 16 and two rear legs 18 fixed to each other by an upper structure 19 (visible in FIGS. 3-6) to which the chair structure 14 is fixed. However, the present invention is not limited to chairs with bases of this type. For example, the base 12 could have a central column and lower arms provided with wheels like normal office chairs or could be formed by a slide or cantilevered frame.

The chair structure 14 comprises a seat 20 and a backrest 22. The backrest 22 has two lateral edges 24, an upper back section 26 and a lumbar section 28, which extends between the upper back section 26 and the seat 20.

In the example illustrated in the figures, the chair structure 14 is formed by a single shaped piece of plastic material, which can be produced by injection-molding. In possible embodiments, the upper backrest section 26 and the lumbar section 28 could be constituted by two distinct components, even formed of different materials, fixed to each other by any type of fixing means. The seat 20 could also be a separate component fixed to the backrest 22 by fixing means of any type.

Figure 2:
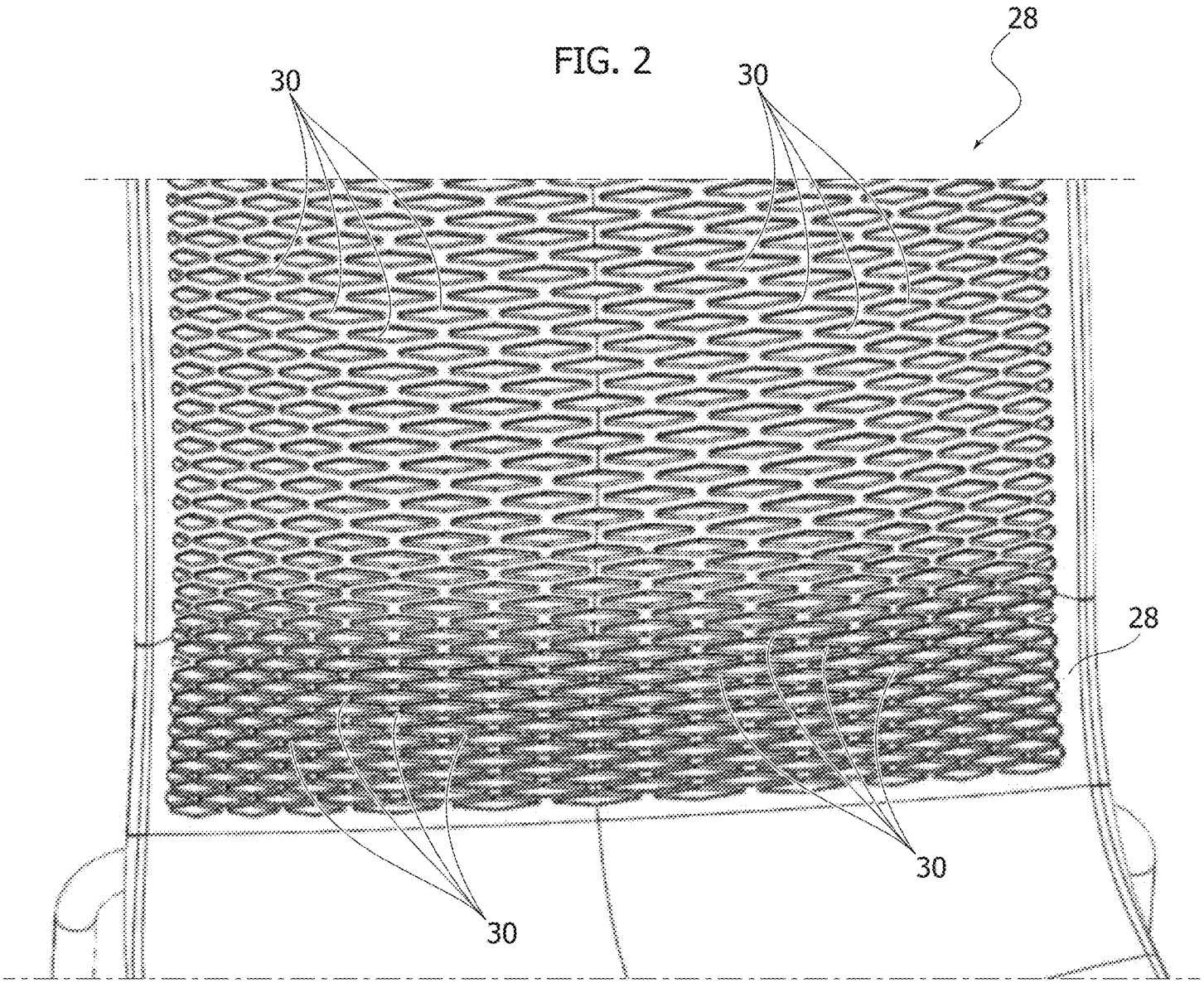
FIG. 2 is a detail on a larger scale of the part indicated by the arrow II in FIG. 1, FIGS. 3 and 4 are side views of the chair of FIG. 1, respectively, in the rest position and in the position of maximum backward tilt of the backrest.

With reference to FIG. 2, the lumbar section 28 comprises a plurality of perforations 30, which extend uniformly along the entire surface of the lumbar section 28 comprised between the lateral edges 24 of the backrest 22. The perforations 30 make the lumbar section 28 elastically deformable.

The perforations 30 are elongated in a horizontal direction. In the example illustrated in the Figures, the perforations 30 have a rhomboid shape with a horizontal major axis and a vertical minor axis. The perforations 30 are arranged in a plurality of horizontal arrays parallel to each other, wherein in each horizontal array the perforations 30 have their respective major axes aligned with each other. The perforations 30 of two adjacent horizontal arrays may have the respective minor axes offset from each other in the horizontal direction, by a distance equal to half the distance between the minor axes of the perforations 30 of the same horizontal array.

The perforations 30 may have a geometry that is different from the rhomboidal one, for example elliptical or any other shape that facilitates the deformability of the area covered by the perforations 30.

With reference to FIGS. 3-6, the lumbar section 28 is elastically deformable to allow a backward tilting movement of the upper backrest section 26 under a backward thrust applied by the user's back. The upper backrest section 26 is movable between a rest position illustrated in FIGS. 3 and 5 and a position of maximum backward tilt illustrated in FIGS. 4 and 6.

Figure 3:
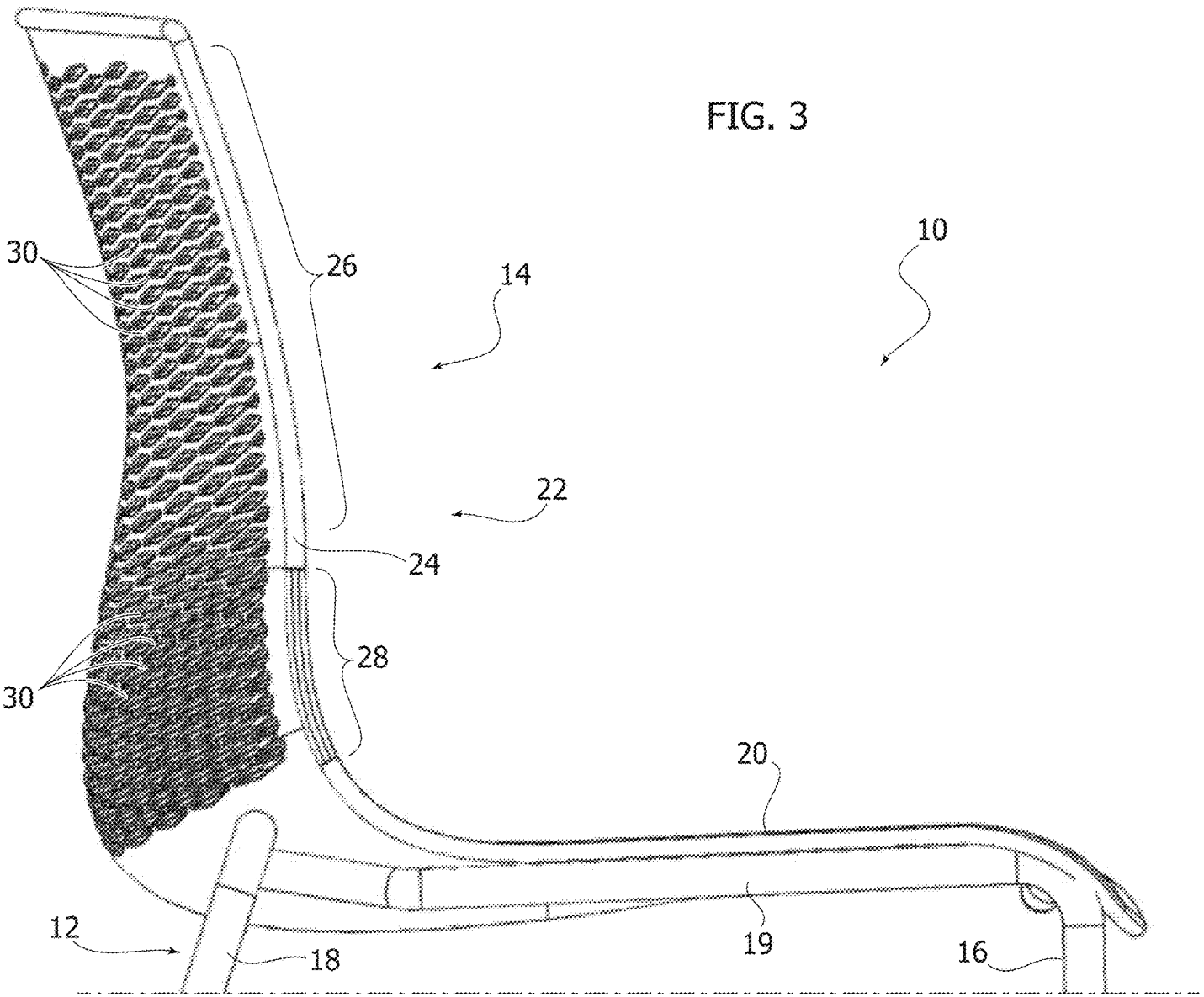
Figure 4:
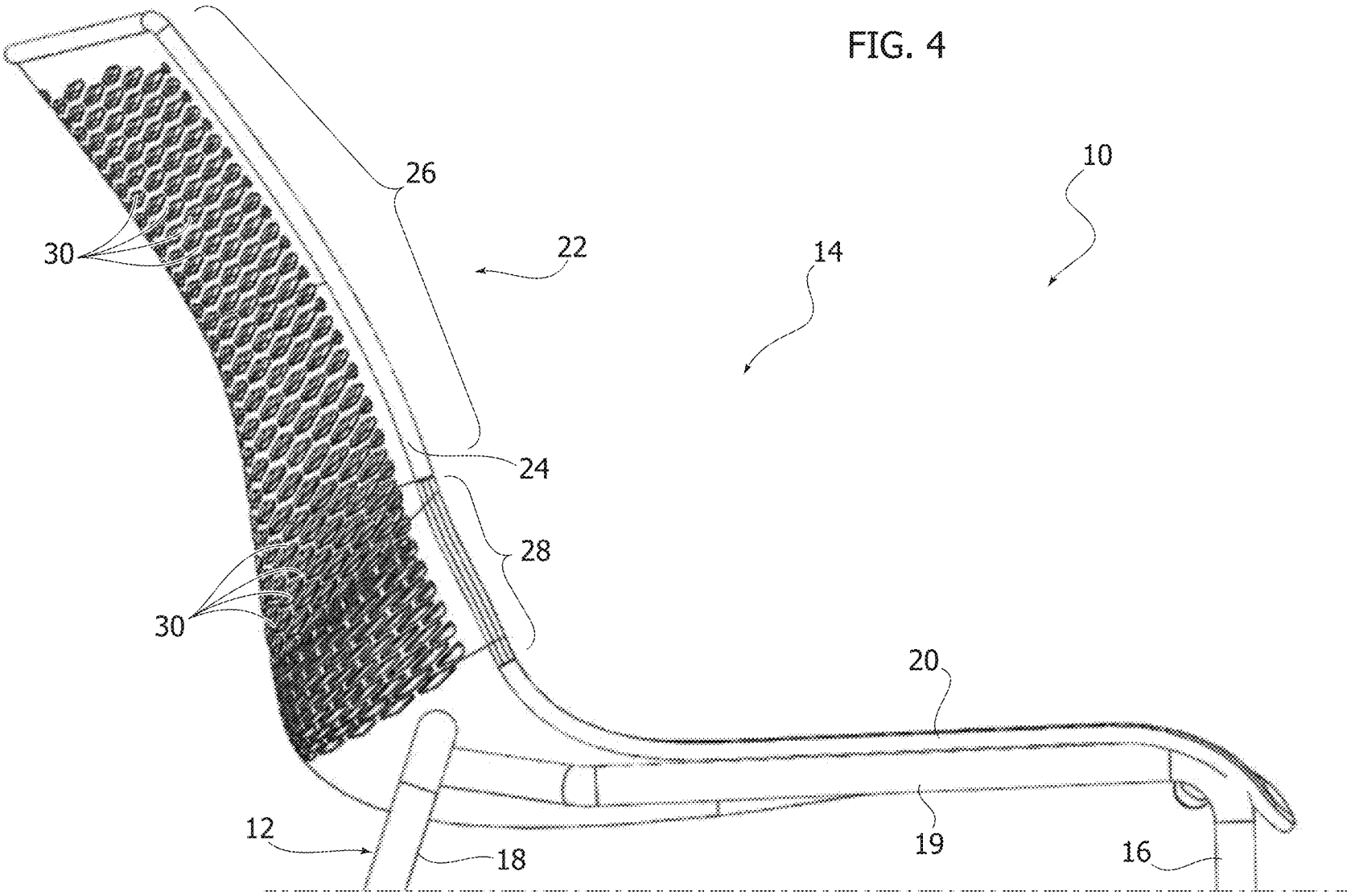
Figure 5:
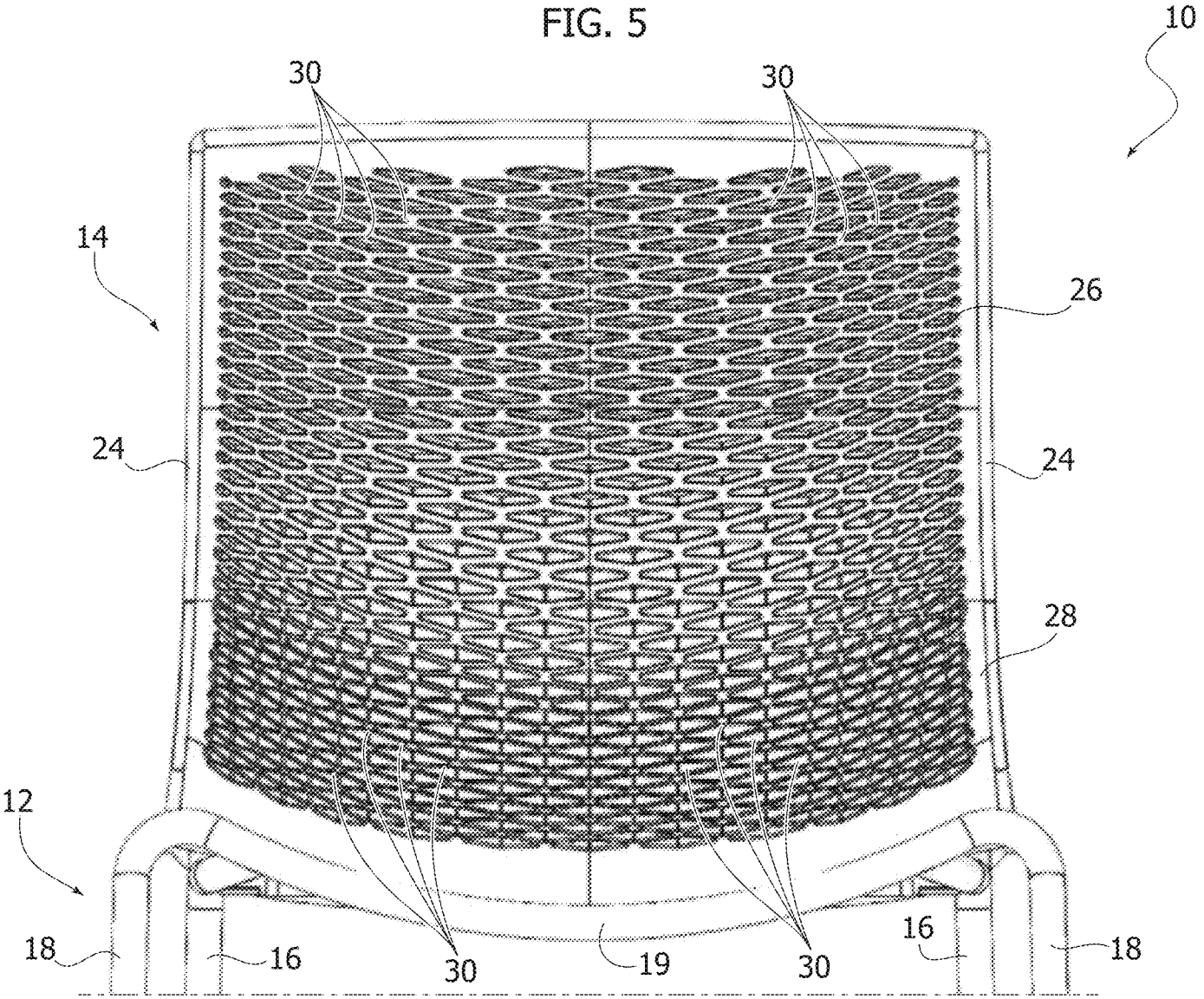
FIGS. 5 and 6 are front rear views of the chair of FIG. 1, respectively, in the rest position and in the position of maximum backward tilt of the backrest.

As can be seen from comparing FIGS. 3, 4 with 5, 6, during the backward tilting movement of the upper backrest section 26, the perforations 30 of the lumbar section 28 compress and allow elastic flexion of the lumbar section 28.

The upper backrest section 26 is configured to remain non-deformed during deformation of the lumbar section 28.

Figure 7:
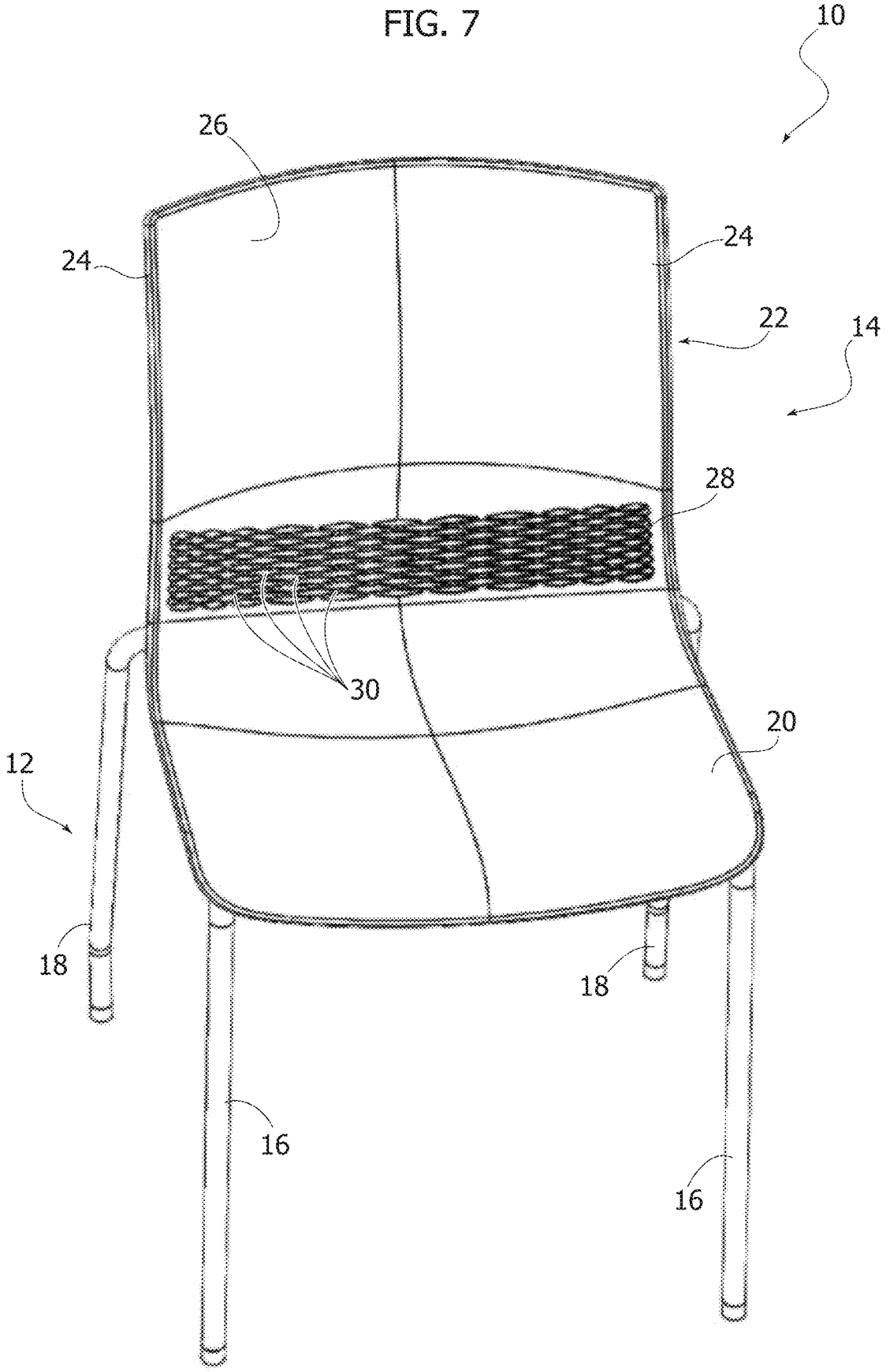
FIG. 7 is a perspective view of a second embodiment of a chair according to the present invention.

To concentrate the deformation of the backrest 22 on the lumbar section 28, the perforations 30 may be provided only on the lumbar section 28, while the upper backrest section may be without perforations, as illustrated in the embodiment of FIG. 7.

In the embodiment of FIGS. 1 and 3-6, the perforations 30 may extend both on the lumbar section 28 and on the upper backrest section 26, so as to give a uniform aesthetic appearance to the entire surface of the backrest 22. In possible embodiments, the perforations 30 may also be provided on the seat 20.

In order to concentrate the elastic deformation of the backrest 22 in the lumbar region 28, the thickness of the walls surrounding the perforations 30 of the lumbar section 28 may be, on average, less than the thickness of the walls surrounding the perforations of the upper back section 26. By varying the relative thickness of the walls of the perforations 30 of the lumbar section 28 and of the upper backrest section 26, it is possible to obtain areas of the backrest 22 characterized by different degrees of resistance to the flexion. For aesthetic reasons it is possible to achieve a gradual variation of the thickness of the walls of the perforations 30, passing from the lumbar section 28 to the upper backrest section 26. Alternatively, a solution can be achieved wherein the thickness of the walls of the perforations 30 of the lumbar section 28 and of the upper backrest section 26 changes step by step along a separation line between the lumbar section 28 and the upper back section 26.

The variation in the thickness of the walls of the perforations 30 may be obtained by varying the distance between the horizontal arrays of perforations 30. In a possible embodiment, the average distance between the horizontal rows of perforations 30 in the upper backrest section 26 is greater than the average distance between the horizontal rows of perforations 30 in the lumbar section 28.

The non-deformability of the upper backrest section 26 may also be obtained, as well as by thickening the walls of the perforations 30, by modifying the shape of the perforations 30 of the upper back section 26 with respect to the shape of the perforations 30 of the lumbar section 28, for example, by decreasing the ratio between the major axis and the minor axis of the perforations 30 or by gradually changing the shape of the perforations 30.

In the embodiment illustrated in the figures, there is a single deformable area located in the lumbar section 28 of the backrest 22, while the remaining part of the backrest 22 remains non-deformable. In possible variants, different deformable areas characterized by different degrees of deformability could be provided.

The perforations 30 of the lumbar section 28 are configured to stop the backward tilting movement of the upper backrest section 26 in the position of maximum backward tilt of the upper backrest section 26.

Figure 6:
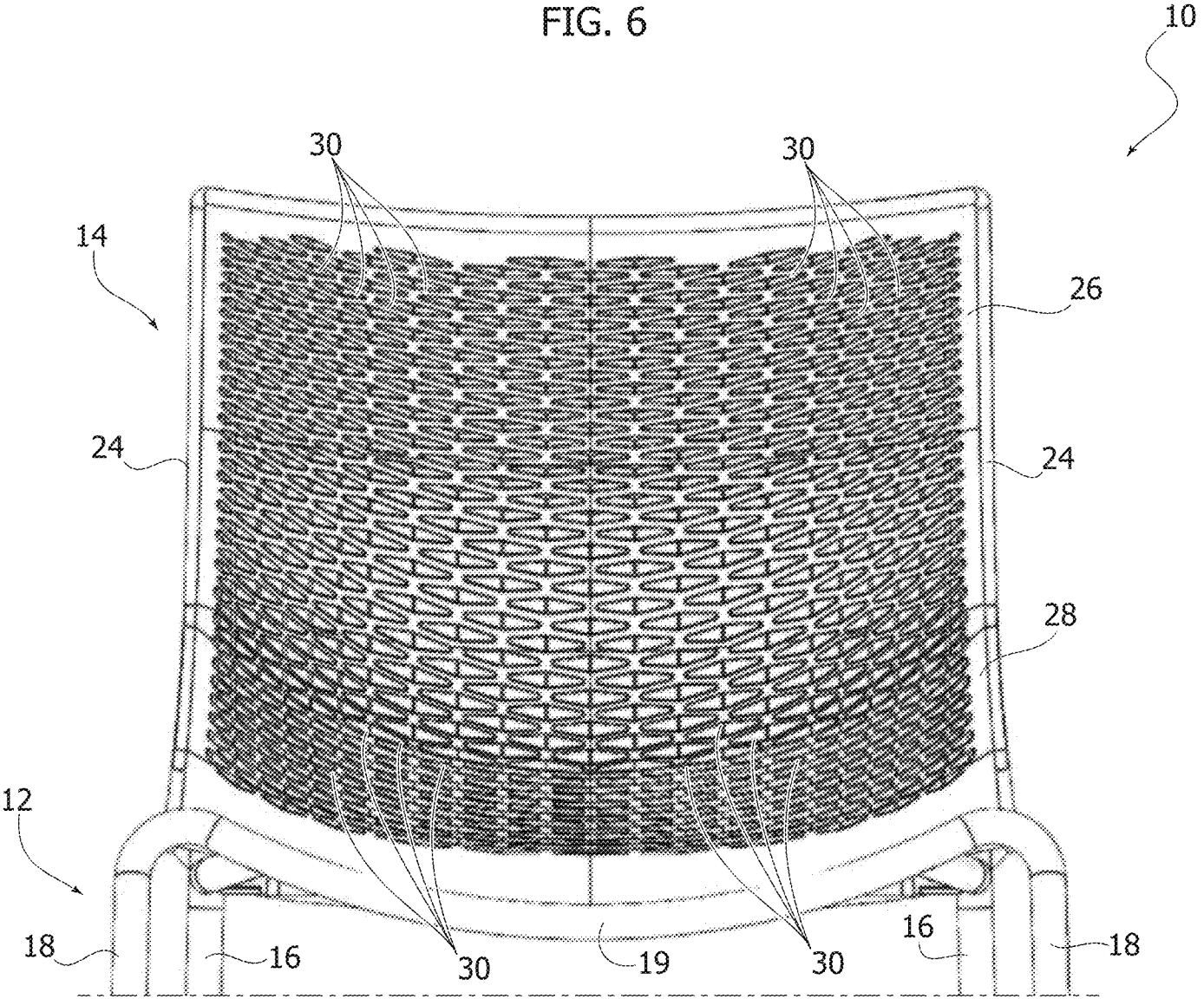

FIGS. 4 and 6 show how in the position of maximum backward tilt of the upper backrest section 26, the lumbar section 28 deforms, preventing a further backward tilting movement of the upper backrest section 26.

In a possible embodiment, in the position of maximum backward tilt of the upper backrest section 26, the opposite walls of the perforations 30 of the lumbar section 28 come into mutual contact, so as to prevent further backward tilt of the upper backrest section 26. In this case, the perforations 30 of the lumbar section 28 are substantially closed in the stop condition.

In other possible embodiments, in the position of maximum backward tilt of the upper backrest section 26, the material comprised between the perforations 30 of the lumbar section 28 compresses so as to prevent further deformation of the lumbar section 28 and, therefore, a further tilt backwards of the upper backrest section 26. In this case, during the compression of the perforations 30, the vertical squashing of the perforations 30 causes compression of the material between adjacent perforations 30 up to the point wherein further deformation of the lumbar section 28 is no longer possible. Therefore, it is possible to make a stop to the backward tilting movement of the upper backrest section 26, even without the perforations 30 closing completely.

Of course, without prejudice to the principle of the invention, the details of construction and the embodiments can be widely varied with respect to those described and illustrated, without thereby departing from the scope of the invention as defined by the claims that follow.

The invention claimed is:

1. A chair comprising:

a seat and a backrest, wherein the backrest comprises two lateral edges, an upper backrest section and a lumbar section, wherein the lumbar section extends between the upper backrest section and the seat, wherein said lumbar section is provided with a plurality of perforations that extend uniformly between said two lateral edges, and wherein the lumbar section is elastically deformable to allow a backward tilting movement of the upper backrest section between a rest position and a position of maximum backward tilt under a backward thrust adapted to be applied by a user's back, wherein said plurality of perforations are configured to stop the backward tilting movement of the upper backrest section in said position of maximum backward tilt, wherein said perforations have a rhomboid shape and are elongated in a horizontal direction and have a structure including a horizontal major axis and a vertical minor axis, wherein said perforations are arranged in horizontal arrays parallel to each other, and wherein the perforations of each horizontal array have respective horizontal major axes aligned with each other, wherein the plurality of perforations of two adjacent horizontal arrays have respective vertical minor axes offset from each other in the horizontal direction by a distance equal to half the distance between the vertical minor axes of the plurality of perforations of the same array, and wherein in said position of maximum backward tilt of the upper backrest section, opposite walls of said plurality of perforations come into mutual contact, so as to prevent a further backward tilt of the upper backrest section.

2. The chair of claim 1, wherein said plurality of perforations only extend on said lumbar section.

3. The chair of claim 1, wherein said plurality of perforations extend on said lumbar section and on said upper backrest section.

4. The chair of claim 1, wherein the seat and the backrest are formed in a single shaped piece of plastic material.

5. A chair comprising:

a seat and a backrest, wherein the backrest comprises two lateral edges, an upper backrest section and a lumbar section, wherein the lumbar section extends between the upper backrest section and the seat, wherein said lumbar section is provided with a plurality of perforations that extend uniformly between said two lateral edges, and wherein the lumbar section is elastically deformable to allow a backward tilting movement of the upper backrest section between a rest position and a position of maximum backward tilt under a backward thrust adapted to be applied b a user's back, wherein said plurality of perforations are configured to stop the backward tilting movement of the upper backrest section in said position of maximum backward tilt, wherein said perforations have a rhomboid shape and are elongated in a horizontal direction and have a structure including a horizontal major axis and a vertical minor axis wherein said perforations are arranged in horizontal arrays parallel to each other, and wherein the perforations of each horizontal array have respective horizontal major axes aligned with each other, wherein the plurality of perforations of two adjacent horizontal arrays have respective vertical minor axes offset from each other in the horizontal direction by a distance equal to half the distance between the vertical minor axes of the plurality of perforations of the same array, wherein in said position of maximum backward tilt of the upper backrest section, a material comprised between the plurality of perforations compresses so as to prevent a further backward tilt of the upper backrest section.

6. A chair comprising:

a seat and a backrest, wherein the backrest comprises two lateral edges, an upper backrest section and a lumbar section, wherein the lumbar section extends between the upper backrest section and the seat, wherein said lumbar section is provided with a plurality of perforations that extend uniformly between said two lateral edges, and wherein the lumbar section is elastically deformable to allow a backward tilting movement of the upper backrest section between a rest position and a position of maximum backward tilt under a backward thrust adapted to be applied b a user's back, wherein said plurality of perforations are configured to stop the backward tilting movement of the upper backrest section in said position of maximum backward tilt, wherein said perforations are elongated in a horizontal direction and have a structure including a horizontal major axis and a vertical minor axis, wherein said perforations are arranged in horizontal arrays parallel to each other, and wherein the perforations of each horizontal array have respective horizontal major axes aligned with each other, wherein each of said plurality of perforations have respective surrounding walls having respective wall thicknesses, and wherein the wall thicknesses of the plurality of perforations of the lumbar section are on average lower than the wall thicknesses of the plurality of perforations of the upper backrest section.

* * * * *